US008273424B2

(12) United States Patent
Van Reijen

(10) Patent No.: US 8,273,424 B2
(45) Date of Patent: Sep. 25, 2012

(54) ARTIFICIAL GRASS FIELD

(75) Inventor: Peter Van Reijen, Uden (NL)

(73) Assignee: Tapijtfabriek H. Desseaux N.V., Waalwijk (NL)

( * ) Notice: Subject to any disclaimer, the term of this patent is extended or adjusted under 35 U.S.C. 154(b) by 471 days.

(21) Appl. No.: 12/499,255

(22) Filed: Jul. 8, 2009

(65) Prior Publication Data

US 2010/0009100 A1 Jan. 14, 2010

(30) Foreign Application Priority Data

Jul. 10, 2008 (NL) ..... 1035682

(51) Int. Cl.
*A41G 1/00* (2006.01)
*D01D 5/12* (2006.01)
*B32B 3/02* (2006.01)

(52) U.S. Cl. ..... 428/17; 428/92; 428/97; 428/373; 428/397; 264/210.1

(58) Field of Classification Search ..... 428/17, 428/97, 92, 373, 397; 264/210.1
See application file for complete search history.

(56) References Cited

U.S. PATENT DOCUMENTS

| | | | | |
|---|---|---|---|---|
| 3,249,669 | A | 5/1966 | Jamieson | 264/177.13 |
| 3,700,544 | A * | 10/1972 | Matsui | 428/373 |
| 3,837,980 | A | 9/1974 | Nishimura, et al. | 428/17 |
| 3,914,488 | A | 10/1975 | Gorrafa | 428/397 |
| 5,759,926 | A * | 6/1998 | Pike et al. | 442/333 |
| 6,432,505 | B1 | 8/2002 | Sweenie et al. | 428/92 |
| 6,620,505 | B1 | 9/2003 | Abe et al. | 428/364 |
| 6,624,100 | B1 * | 9/2003 | Pike | 442/340 |
| 2005/0031828 | A1 * | 2/2005 | Yoshida | 428/92 |
| 2007/0166507 | A1 | 7/2007 | Atsma et al. | 428/85 |

FOREIGN PATENT DOCUMENTS

| | | | |
|---|---|---|---|
| EP | 0996781 | | 5/2000 |
| EP | 1219732 | | 7/2002 |
| EP | 1837423 | | 9/2007 |
| JP | 03064550 | | 3/1991 |
| JP | 03234818 | A * | 10/1991 |
| JP | 03241055 | A * | 10/1991 |
| JP | 09242012 | | 9/1997 |
| JP | 2002061032 | A * | 2/2002 |
| JP | 2002 161452 | | 6/2002 |
| JP | 2011009150 | A * | 1/2011 |
| NL | 7412540 | | 3/1975 |
| WO | WO 9202669 | A * | 2/1992 |
| WO | WO 99/04074 | | 1/1999 |
| WO | WO2004/106601 | | 12/2004 |
| WO | WO2005/111281 | | 11/2005 |

* cited by examiner

*Primary Examiner* — Cheryl Juska
(74) *Attorney, Agent, or Firm* — Roberts & Roberts, LLP

(57) ABSTRACT

An artificial grass fiber is formed, which fiber has an elongated cross-section that remains substantially constant along its longitudinal axis. An artificial lawn comprising these artificial grass fibers is provided, as well as to the use of the aforesaid artificial grass fibers. The fibers collectively provide a special type of artificial grass which imitates the advantageous characteristics of natural grass, in particular in the field of ball roll and sliding characteristics.

21 Claims, 3 Drawing Sheets

ARTIFICIAL GRASS FIELD

BACKGROUND OF THE INVENTION

The present invention relates to an artificial grass fibre having an elongated cross-section that remains substantially constant along its longitudinal axis. The present invention further relates to an artificial lawn comprising artificial grass fibres as well as to the use of the aforesaid artificial grass fibre.

FIELD OF THE INVENTION

Artificial grass fibres are known per se from European patent EP 0 996 781 granted to the present applicant, in which a yarn containing polyamide is used for producing artificial grass, wherein said yarn, in addition to polyamide, also contains a polyolefin compound selected from the group consisting of polypropylene, LLDPE and a block copolymer of polypropylene and polyethylene. In addition to the method for manufacturing a yarn that is known therefrom, in which the polymer is extruded so as to form monofilaments, which are subsequently further processed to form bands, with several bands being twined to form a yarn, said document discloses a method in which the yarn is formed by co-extrusion. During such co-extrusion, the cladding consists of polyamide, whilst the core consists of one of the aforesaid plastic materials.

From International application WO 2005/111281 there is known a method for producing a synthetic fibre for use in an artificial grass sports field, in which the layer of synthetic material obtained by co-extrusion is composed of at least two layers of different plastics, with the co-extrusion step providing a separation of the different properties of the synthetic materials that are used. According to a first embodiment, the layer of synthetic material is composed of a core layer of a first synthetic material, which core layer is surrounded on both sides by one or more outer layers each consisting of a different synthetic material; in particular, a hydrophilic additive, for example ethylene vinyl alcohol copolymer or polyhydroxyethyl methylacrylate, can be used as the outer layer of the co-extrusion fibre.

From International application WO 2004/106601 there is known a yarn for an artificial lawn, in which the yarn is a so-called tape filament consisting of a core layer and two outer layers of a different material than the core layer, wherein the core layer contains polyester and/or polyolefin material and the outer layers contain high-density polyethylene.

From Dutch laid-open publication No. 7412540 there is known a polyester fibre for the production of fur-like pile fabrics, wherein the ratio between the length and the width, measured along an axis of symmetry, has a specific value, which configuration is in particular intended to provide fur-like polyester materials providing a smooth, non-tacky resilient hand and pleasing luster. The use of such fibre materials in an artificial lawn is not known therefrom, nor is it suggested therein.

From U.S. Pat. No. 3,249,669 there is known a process for making composite polyester filaments, in which several cross-sections of the fibre are disclosed, which fibres are used in clothing. The use of such fibre materials in an artificial lawn is not known therefrom, nor is it suggested therein.

An important aspect in playing ball sports on an artificial lawn consisting of synthetic fibres is the ball roll. Because in particular in the case of hockey and soccer the role of the ball is an important aspect of the game, it is desirable that the extent to which the ball rolls corresponds more or less to the extent to which the ball would roll on a natural lawn. It should be noted in this regard that the ball roll must not change in an adverse manner in the course of the technical life of the artificial lawn.

Another phenomenon associated with artificial grass, in particular if the artificial grass is used for playing soccer, is the occurrence of friction bums when players make a sliding tackle. This problem does not occur with natural grass, which natural material has a high water content and feels soft upon contact, so that the friction with the skin will be high. From the viewpoint of skin damage this high friction is disadvantageous, but on account of the fact that the natural grass will wear off slightly upon contact, there will be no question of friction burns upon contact between the skin and the natural grass. In addition to that, natural grass is soft and will grow again soon after wearing off, in which connection it can moreover be noted that the relatively soft nature of natural grass also contributes to good resilience properties.

The selection of the material used for artificial grass, on the other hand, generally involves a controversy. The material used for the artificial grass is for example a soft material having a large elastic range. Such a property results in a good resilience, but also in a high degree of friction, which latter aspect will lead to excessive adhesion of the skin to the artificial grass when making a sliding tackle, and thus inevitably to skin damage, which is undesirable. As regards the heat development that takes place during such a sliding tackle, these materials are assessed to have negative characteristics, in spite of the fact that the contact time between the skin and the artificial grass remains limited on account of the high degree of friction. The material used for the artificial grass may also be a hard material having a small elastic range, which results in poor resilience properties but a limited degree of friction. The limitation as regards the degree of friction will reduce the extent to which skin damage occurs. In addition to that, said hard materials are assessed to have positive characteristics as regards the heat development during sliding tackles, because the contact time is longer.

The aforesaid artificial lawns have been known for many years, with field hockey being one of the most frequently played sports on artificial grass. Also soccer, rugby, tennis, skiing and golf can be mentioned in this connection.

To avoid the aforesaid problems as regards human skin-lawn interaction, it is common practice to spray water onto the artificial lawn in large amounts, in particular during important sports contests. Artificial lawns used for playing field hockey are thus practically completely inundated, which is undesirable for environmental reasons.

SUMMARY OF THE INVENTION

It is an object of the present invention to provide a special type of artificial grass which imitates the advantageous characteristics of natural grass, in particular in the field of ball roll and sliding characteristics, as much as possible.

Another object of the present invention is to provide an artificial grass which is very durable and which can be composed of commercially available materials.

The present invention as referred to in the introduction is characterised in that said cross-section is wedge-shaped, said wedge shape having a length A and a width B, the ratio A:B being in the 2-12.5 range.

One or more of the above objects are accomplished when such a cross-sectional shape is used. The present inventors have in particular found that the aforesaid ratio A:B leads to improved ball roll, stiffness and sliding tackle characteristics in comparison with a conventional artificial grass fibre, whose cross-section can be called practically round.

In a special embodiment, the width B is preferably in the 200-500 μm range, with the length A preferably ranging from 1-2.5 mm. The present inventors have found that when values outside the aforesaid ranges are used for B and A, the artificial grass fibre exhibits a degree of stiffness which is undesirable for playing (ball) sports, or even no stiffness at all.

An artificial lawn comprises a substrate layer with artificial grass fibres projecting therefrom, preferably realised by mechanically connecting the artificial grass fibres to the substrate layer, for example by means of a weaving, knitting or tufting technique, so that the artificial grass fibres are more or less similar to the natural grass lawn comprising upright grass stalks. The artificial lawn may be provided with an infill material, for example sand and/or rather, at the upper surface side. In a special embodiment, the artificial lawn also comprises an amount of natural grass in addition to artificial grass fibres.

The artificial grass fibre used in the present invention is preferably made of a material selected from the group of polyesters, polypropylene, ethyl vinyl acetate (EVA), saturated styrene thermoplastic elastomer (SEBS), polyamides, polyethylene compounds and copolymers of ethylene and acrylate, or combinations thereof.

Suitable polyethylene compounds include: high density polyethylene (HDPE), medium density polyethylene (MDPE), low density polyethylene (LDPE), linear low density polyethylene (LLDPE) and anhydride modified polyolefins, in particular polypropylene compounds and polyethylene compounds. Polyethylene terephthalate and/or polytrimethylene terephthalate (PTT) are in particular used as polyesters. Suitable polyamides include polyamides of the type 6, 6.6, 6.10 and 6.12, or combinations thereof, in particular co-PA (6/66) and/or polyamide 6.

In a special embodiment of the present invention, the artificial grass fibre may consist of a core and a cladding, with the core and the cladding being made of different materials. It is in particular preferable if the core material comprises one or more of the aforesaid materials. The material for the cladding is preferably selected to be a material having a hydrophilicity higher than that of the material used for the core. When such a type of artificial grass fibre is used, the artificial grass will exhibit some degree of moisture absorption, so that the ball will roll over the field more easily when a ball sport, in particular field hockey, is played thereon. In the case of a contact sport, in particular soccer, the risk of injury, for example after making a sliding tackle, is moreover minimised. Suitable materials for the cladding include: polyurethane, cellulose, chitosan, polyvinyl alcohol and derivatives thereof, or a combination thereof, in which connection it is in particular desirable to use one or more derivatives of cellulose belonging to the group of viscose, ethyl cellulose, cellulose acetate butyrate (CAB), cellulose acetate propionate (CAP), cellulose (di)acetate and cellulose (tri)acetate.

It is in particular preferable if the dtex value of the overall artificial grass fibre ranges between 4000 and 20,000.

The present invention further relates to a method for producing an artificial grass fibre, using an extrusion process, in which the material exiting the extruder is stretched to an extent of 1:3-1:7.

The present invention further relates to the use of an artificial grass fibre having a wedge-shaped cross-section as described in the foregoing in an artificial lawn for the purpose of improving the sliding behaviour.

The present invention further relates to the use of an artificial grass fibre having a wedge-shaped cross-section as described in the foregoing in an artificial lawn for the purpose of improving the ball roll.

DETAILED DESCRIPTION OF THE INVENTION

The artificial grass fibre as described above may contain usual additives for improving the UV stability, the colourfastness, the anti-static properties and the like. In addition to that, mixtures of polymers may be used in the artificial grass fibre for the purpose of improving specific properties, in which connection in particular plastomers are to be considered.

The present invention will be explained in more detail hereinafter by means of a number of examples, in which connection it should be noted, however, that such examples should not be considered as limitative.

BRIEF DESCRIPTION OF THE DRAWINGS

In the appended FIG. 1, a cross-sectional view of the present artificial grass fibre is shown, with the wedge-shaped configuration being characterised by two parameters, viz. the width B and the length A. In this figure, the artificial grass fibre rises "from the paper", therefore. The width B of the wedge shape preferably ranges from 200-500 μm, with the length A of the wedge shape preferably ranging from 1-2.5 mm. The height or longitudinal axis of the artificial grass fibre is not critical and usually amounts to 9-70 mm. The wedge-shaped configuration preferably extends the entire height of the artificial grass fibre, so that the present wedge shape is present both near the "backing" (not shown) and at the other end of the artificial grass fibre.

Figure 1:
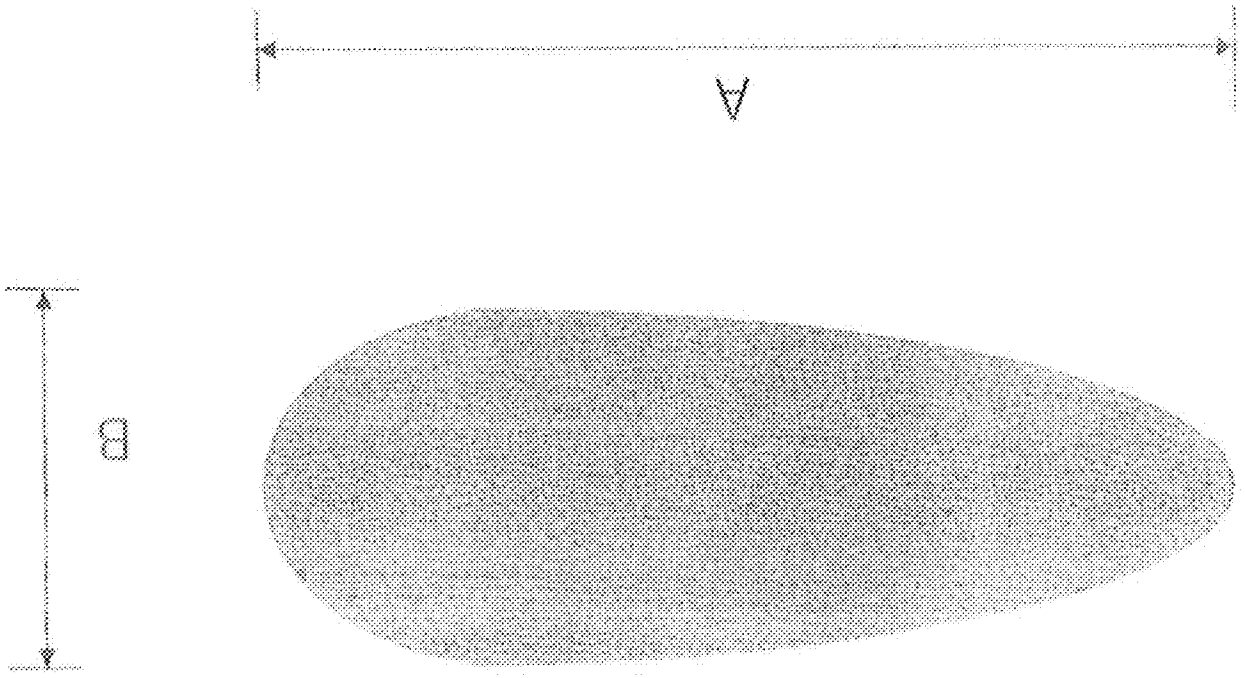
Figure 2:
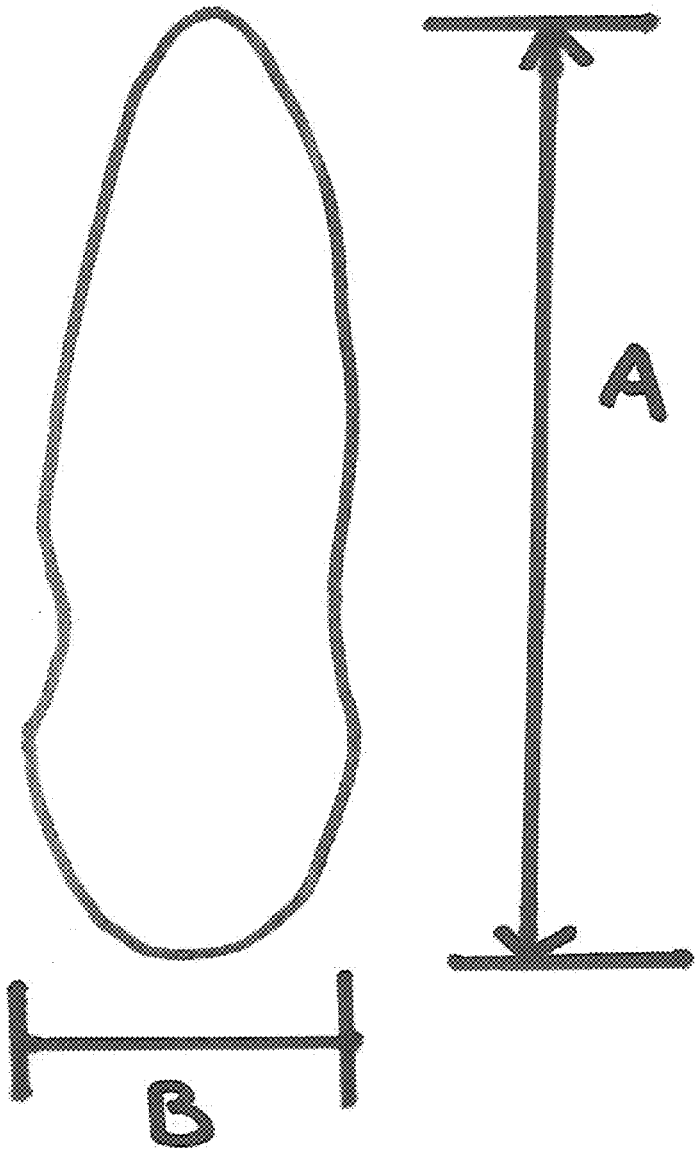
FIG. 2 shows a cross-sectional view of a special embodiment of the present artificial grass fibre, in which the wedge-shape exhibits a narrowing at the "thickened" end on both sides. The aforesaid narrowing is in particular desirable from the viewpoint of preventing the occurrence of curling. The present inventors have found that curling is mainly caused by an accumulation of material, viz. mass, on one side of the artificial grass fibre relative to the other side. The degree of narrowing is such that the artificial grass fibre retains sufficient dimensional stability to prevent undesirable breaking or tearing thereof.
Figure 3:
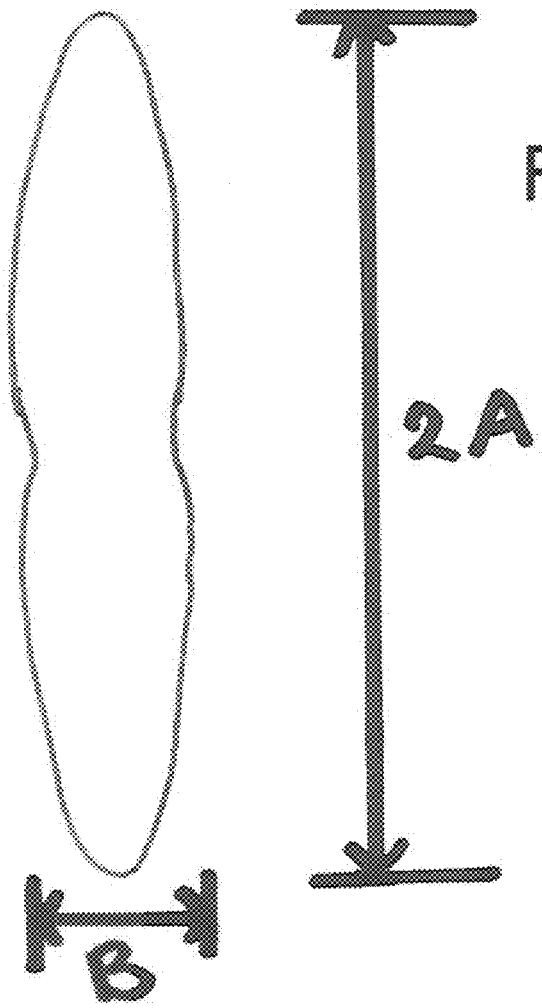
FIG. 3 shows a cross-sectional view of a special embodiment of the present artificial grass fibre, in which the wedge shape is in fact a "double" wedge shape, with the "thickened" ends of each wedge shape being connected, with some degree of narrowing again occurring around the central region of the artificial grass fibre. The narrowed central region is present in a special embodiment of the "double" wedge shaped and may also be absent in certain embodiments (not shown). The embodiments shown in FIG. 2 and FIG. 3 both comprise the characteristic parameters A and B that are essential for the present artificial grass fibre.

The invention claimed is:

1. An artificial grass fiber having an elongated cross-section that remains substantially constant along its longitudinal axis, wherein said cross-section is wedge-shaped, said wedge shape having a length A and a width B, the ratio A:B being in the 2-12.5 range, wherein the artificial grass fiber comprises a core and a cladding, with the core and the cladding being made of different materials, the material for the core comprising one or more of polyesters, polypropylene, ethyl vinyl acetate, saturated styrene thermoplastic elastomer, polyamides, polyethylene compounds and copolymers of ethylene and acrylate, or combinations thereof.

2. The artificial grass fiber according to claim 1, wherein the material for the cladding is comprised of polyurethane, cellulose, cellulose derivatives, chitosan, polyvinyl alcohol and derivatives thereof, or a combination thereof.

3. The artificial grass fiber according to claim 2, wherein the derivatives of cellulose comprise viscose, ethyl cellulose, cellulose acetate butyrate, cellulose acetate propionate, cellulose (di)acetate, cellulose (tri)acetate and combinations thereof.

4. The artificial grass fiber according to claim 1, wherein the width B is in the 200-500 μm range.

5. The artificial grass fiber according to claim 1, wherein the length A is in the 1-2.5 mm range.

6. The artificial grass fiber according to claim 1, wherein the polyethylene compounds comprise one or more of high density polyethylene, medium density polyethylene, low density polyethylene, linear low density polyethylene, anhydride modified polyolefins, and polypropylene compounds.

7. The artificial grass fiber according to claim 1, wherein the polyester comprises polyethylene terephthalate and/or polytrimethylene terephthalate.

8. The artificial grass fiber according to claim 1, wherein the polyamide comprises co-polyamide (6/66) and/or polyamide-6.

9. An artificial grass fiber having an elongated cross-section that remains substantially constant along its longitudinal axis, wherein said cross-section is wedge-shaped, said wedge shape having a length A and a width B, the ratio A:B being in the 2-12.5 range, wherein the width B is in the 200-500 μm range, and wherein the artificial grass fiber comprises a core and a cladding, with the core and the cladding being made of different materials, the material for the core comprising one or more of polyesters, polypropylene, ethyl vinyl acetate, saturated styrene thermoplastic elastomer, polyamides, polyethylene compounds and copolymers of ethylene and acrylate, or combinations thereof.

10. The artificial grass fiber according to claim 9, wherein the material for the cladding is comprised of polyurethane, cellulose, cellulose derivatives, chitosan, polyvinyl alcohol and derivatives thereof, or a combination thereof.

11. The artificial grass fiber according to claim 10, wherein the derivatives of cellulose comprise viscose, ethyl cellulose, cellulose acetate butyrate, cellulose acetate propionate, cellulose (di)acetate, cellulose (tri)acetate and combinations thereof.

12. An artificial grass fiber having an elongated cross-section that remains substantially constant along its longitudinal axis, wherein said cross-section is wedge-shaped, said wedge shape having a length A and a width B, the ratio A:B being in the 2-12.5 range, wherein the length A is in the 1-2.5 mm range, and wherein the artificial grass fiber comprises a core and a cladding, with the core and the cladding being made of different materials, the material for the core comprising one or more of polyesters, polypropylene, ethyl vinyl acetate, saturated styrene thermoplastic elastomer, polyamides, polyethylene compounds and copolymers of ethylene and acrylate, or combinations thereof.

13. The artificial grass fiber according to claim 12, wherein the material for the cladding is comprised of polyurethane, cellulose, cellulose derivatives, chitosan, polyvinyl alcohol and derivatives thereof, or a combination thereof.

14. The artificial grass fiber according to claim 13, wherein the derivatives of cellulose comprise viscose, ethyl cellulose, cellulose acetate butyrate, cellulose acetate propionate, cellulose (di)acetate, cellulose (tri)acetate and combinations thereof.

15. An artificial lawn comprising artificial grass fibers according to claim 1.

16. The artificial lawn according to claim 15, wherein the width B is in the 200-500 μm range.

17. The artificial lawn according to claim 15, wherein the length A is in the 1-2.5 mm range.

18. The artificial lawn according to claim 15, wherein the polyethylene compounds comprise one or more of high density polyethylene, medium density polyethylene, low density polyethylene, linear low density polyethylene, anhydride modified polyolefins, and polypropylene compounds.

19. The artificial lawn according to claim 15, wherein the polyester comprises polyethylene terephthalate and/or polytrimethylene terephthalate.

20. The artificial lawn according to claim 15, wherein the polyamide comprises co-polyamide (6/66) and/or polyamide-6.

21. A method for producing an artificial grass fiber comprising the steps of:

(a) providing a core material and a cladding material to be extruded;

(b) coextruding the core material and the cladding material in an extruder; and (c) stretching the material exiting the extruder to a degree of 1:3-1:7 to produce an artificial grass fiber;

wherein the artificial grass fiber has an elongated cross-section that remains substantially constant along its longitudinal axis, wherein said cross-section is wedge-shaped, said wedge shape having a length A and a width B, the ratio A:B being in the 2-12.5 range, and wherein the artificial grass fiber comprises a core and a cladding, with the core and the cladding being made of different materials, the material for the core comprising one or more of polyesters, polypropylene, ethyl vinyl acetate, saturated styrene thermoplastic elastomer, polyamides, polyethylene compounds and copolymers of ethylene and acrylate, or combinations thereof.

* * * * *